US005333403A

United States Patent [19]

Peifer

[11] Patent Number: 5,333,403

[45] Date of Patent: Aug. 2, 1994

[54] MUZZLE LOADING RIFLES

[76] Inventor: Ralph D. Peifer, R.R. 2, Box 155A, Nokomis, Ill. 62075

[21] Appl. No.: 89,371

[22] Filed: Jul. 9, 1993

Related U.S. Application Data

[63] Continuation-in-part of Ser. No. 995,140, Dec. 22, 1992.

[51] Int. Cl.[5] ..... E41A 35/00

[52] U.S. Cl. ..... 42/69.02; 42/51

[58] Field of Search ..... 42/51, 69.02

[56] References Cited

U.S. PATENT DOCUMENTS 3,546,803 12/1970 Swenson et al. ..... 42/69.02
3,755,947 9/1973 Koon ..... 42/69.02
4,004,364 1/1977 Chatigny ..... 42/69.02
4,457,094 7/1984 Thompson ..... 42/69.02
4,461,109 7/1984 Eguizabal ..... 42/51

*Primary Examiner*—David H. Brown
*Attorney, Agent, or Firm*—Patnaude, Videbeck & Marsh

[57] ABSTRACT

A muzzle loading rifle has a cylindrical primer holder having a transverse hole therethrough which is provided to retain a primer charge. The primer holder may be rotated from a firing position to a safety position while retaining the charge enclosed within the receiver of the rifle. The back end of a breach plug engages the primer holder and an annular ring at the back of the breach plug is sized to be shearable by the breach plug at a predetermined pressure for providing an additional safety feature for the rifle. Shearing the breach plug annular ring is engineered to absorb substantial excess pressure if present.

5 Claims, 5 Drawing Sheets

MUZZLE LOADING RIFLES

This is a continuation-in-part of an application filed Dec. 22, 1992 and assigned Ser. No. 995,140.

The present invention generally relates to rifles, and in particular to muzzle loading rifles.

BACKGROUND OF THE INVENTION

Although the muzzle loading rifle is a weapon of the past, such weapons continue to be in use because the hunting laws of numerous states provide for longer hunting seasons for hunters using bows and arrows and muzzle loading rifles than for modern repeater rifles. As a result, it is desirable to provide a rifle which loads through the muzzle so as to comply with the applicable state hunting laws, but incorporates safety features, and can be easily and safely loaded, primed and cocked.

To fire such weapons, it is necessary that an ignition system be provided which responds to a hammer and ignites a charge of gun powder to propel a bullet from the weapon. The existing muzzle loading weapons have an external retainer upon which a firing cap is positioned and a bore extending from the retainer to the breach of the weapon. To load such weapons, gunpowder is poured into the barrel and some of the gunpowder also fills the small bore leading to the cap retainer. A firing cap is then positioned in the retainer and is struck by the hammer when the weapon is fired.

If too much gun powder is poured into the barrel of such weapons, the subsequent firing of the weapon may cause damage to the weapon, and may cause injury to the users, for example, by causing the hammer to be propelled backward toward the user. If the weapon is excessively overloaded, the breach or barrel of the weapon may explode when the weapon is fired.

It would be desirable to provide a muzzle loading weapon with an enclosed hammer so as to not injure a user if the hammer is propelled backward as the result of firing an overloaded weapon. It would also be desirable to provide a muzzle loading weapon which will exhaust the gasses within the weapon which results from firing it while overloaded and thereby avoid serious damage to the weapon or injury to the user.

BRIEF DESCRIPTION OF THE INVENTION

Briefly, the present invention is embodied in a rifle having a tubular barrel and a tubular receiver positioned behind the barrel for retaining an axially movable hammer. A spring urges the hammer from a rearward cocked position to a forward fired position within the receiver.

In accordance with the present invention, an aperture is provided in the outer wall of the barrel forward of the receiver and behind the breach. A cylindrical primer holder having a transverse hole therethrough adapted to retain a primer charge has a diameter less than the diameter of the aperture in the barrel such that the primer holder may be extended into the barrel with an ignition charge fitted in the transverse hole. The ignition charge in the primer holder will be positioned adjacent and immediately forward of the hammer when it is in the fired position and adjacent and immediately behind the breach of the weapon. A small bore extends through a nipple extending from the rearward end of the breach such that when the weapon is loaded, a flash or spark will travel through the small bore and ignite the charge. Alternately, the primer holder may be rotated within the aperture in the barrel to a safety position in which the axis of the transverse hole is perpendicular to the central longitudinal axis of the barrel. When in the rotated position, a charge fitted into the transverse hole of the primer holder cannot be stricken by the hammer and the rifle will not fire.

The primer holder is retained within the aperture by the annular nipple which extends rearwardly from a breach plug fitted into the barrel and into an annular groove around the circumference of the primer holder. A notch in the groove permits removal of the primer holder when it is rotated to an insert and removal orientation.

An important feature of the present invention is that the nipple is generally tubular in shape and the sides of the tubular nipple are made of thin metal so as to have a relatively low resistance to shear. The resistance to shear is such that when the weapon is fired with an excessive amount of gun powder in the barrel, excess gasses from the powder chamber will be exhausted through the nipple and around the distal end of the primer holder, and will force the primer holder out of the retaining aperture. The nipple, which retains the primer holder within the aperture, will be sheared off as the primer holder is forced out of the aperture, however, except for shearing off the nipple, the weapon will suffer no damage. Also the user will not be injured because the primer holder will be expelled downwardly and away from the user.

BRIEF DESCRIPTION OF THE DRAWINGS

A better understanding of the present invention can be had by a reading of the following detailed description of the invention taken in accompaniment with the drawings wherein.

DETAILED DESCRIPTION OF A PREFERRED EMBODIMENT

Figure 1:
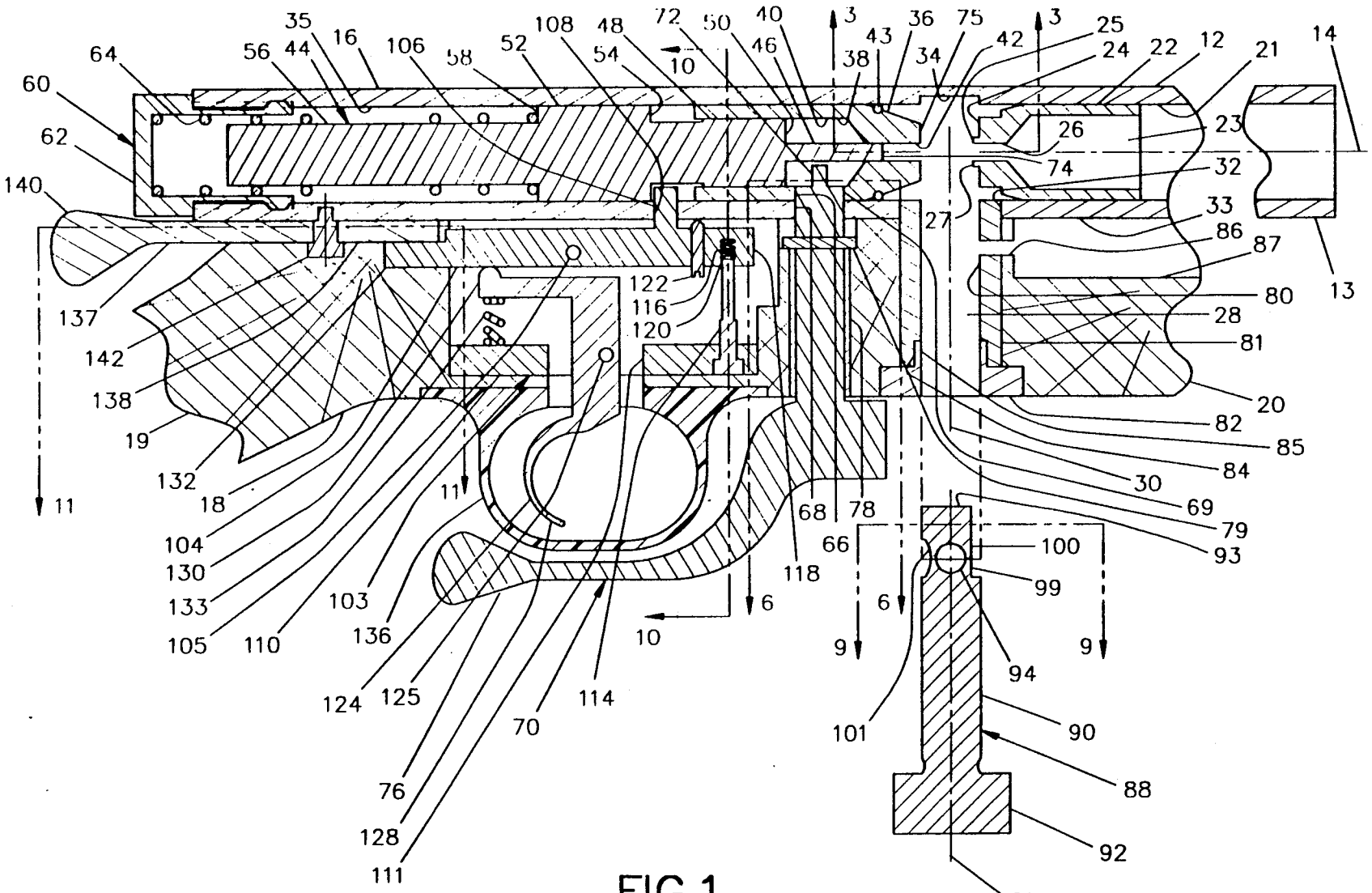
FIG. 1 is a fragmentary cross-sectional view of a rifle in accordance with the present invention showing a primer holder withdrawn from the rifle, the hammer in the cocked position and the safety lever in the locking position.

Referring to FIG. 1, a muzzle loading gun, which is usually a rifle 10, has a barrel 12 at one end of which is a muzzle 13 and adjacent the other end of which is a receiver 16 which may be integral with the barrel 12. The barrel 12 has a central longitudinal axis 14 and the barrel 12 and receiver 16 are attached to a stock 18 by any suitable means, such as screws threaded into the barrel (not shown). The rear end 19 of the stock is adapted to be fitted against the shoulder of a user, and the forward end 20 of the stock 18 is adapted to be grasped by one hand for holding the rifle during firing.

The barrel 12 has an internal bore 21 and fitted within the rear end of the bore 21 is a tubular breach plug 22 having a powder chamber 23 and having a rear wall 24. In accordance with the present invention, extending rearward from the rear wall 24 is a centrally located generally tubular shaped nipple 25, and extending through the rear wall 24 and through the nipple 25 is a narrow axial bore or flash hole 26. The wall 27 of the nipple 25 is thin so as to have a low resistance to shear, but sufficiently thick so as not to be damaged by the insertion and withdrawal of the primer holder described below.

As can be seen in FIG. 1, the outer surface of the rear wall 24 of the breach plug 22 defines part of the walls of a downwardly extending passageway 28 having an axis 30 perpendicular to the central longitudinal axis 14 of the bore 12 which extends into the barrel 12 through a circular aperture 32 in the lower wall 33 of the barrel 12. The passageway 28 extends downwardly through the forward end 20 of the stock 18. Diametrically opposed to and above the aperture 32 is a blind bore 34 in the upper inner surface of the bore 21.

Immediately behind the passageway 28 is the tubular receiver 16 which has a central bore 35 co-axial with the central longitudinal axis of the bore 21 of the barrel 12. At the forward end of the bore 35 of the receiver 16 is a tubular hammer sleeve 36 having a bore 38 extending axially therethrough. The rearward portion 40 of the bore 38 has a relatively large diameter and the forward portion 42 of the bore 38 has a relatively narrow diameter. An 0-ring 43 fitted around the hammer sleeve 36 and within the bore 21 prevents gas from the discharge of the rifle 10 from entering the receiver 16.

Positioned within the receiver 16 is a cylindrical hammer 44 having a cylindrical striking end 46. The diameter of the striking end 46 is a little smaller than the diameter of the forward portion 42 of the axial bore 38 in the hammer sleeve 36 so as to slideably fit therein. Rearward of the striking portion 46, the hammer 44 has a second, larger cylindrical portion 48, defining an annular shoulder 50 between the striking portion 46 and the larger portion 48. The second cylindrical portion 48 is sized to fit slideably with the rearward portion 40 of the bore 38. Rearward of the second cylindrical portion 48 is a third cylindrical portion 52 sized to fit slideably within the bore 35 of the receiver 16, and between the second and third cylindrical portions 48, 52, respectively, is a second shoulder 54. Rearward of the third cylindrical portion 52 of the hammer 44 is a fourth smaller cylindrical portion 56 and between the third and fourth cylindrical portions 52, 56, respectively, is a third rearwardly facing annular shoulder 58.

Threaded into the distal end of the receiver 16 is a tubular cap 60 having a transverse end wall 62. A spring 64 is compressed between the end wall 62 of the tubular cap 60 and the rearwardly facing third annular shoulder 58 of the hammer 44 and is biased so as to urge the hammer 44 towards the muzzle 14 of the rifle 10. The fourth cylindrical portion 56 of the hammer 44 is adapted to fit slideably within the coils of the spring 64.

Figure 2:
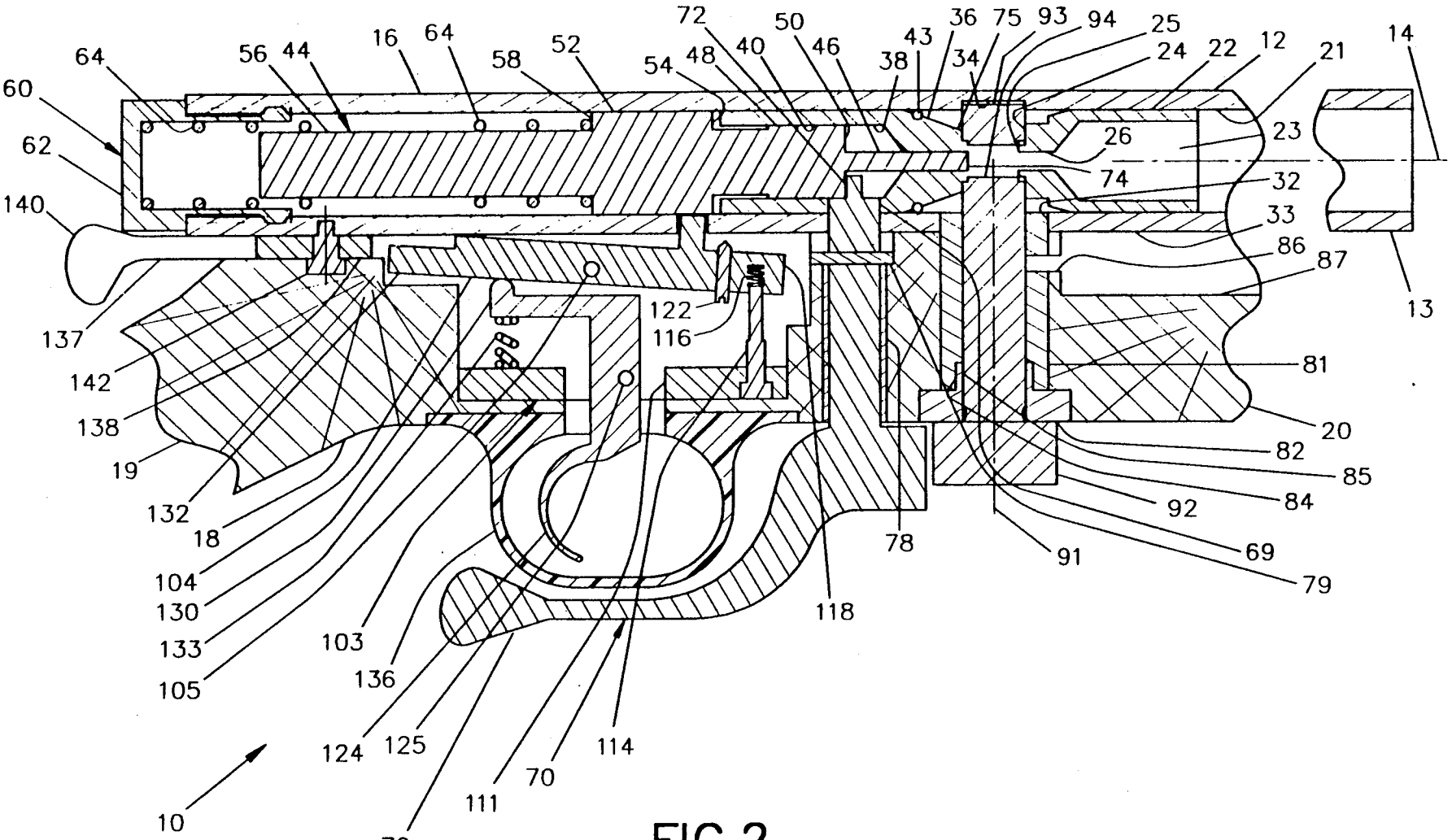
FIG. 2 is a fragmentary cross-sectional view of the rifle in FIG. 1 showing the hammer in the fired position, the primer holder in the firing position, and the safety lever in the unlocked position.
Figure 8:
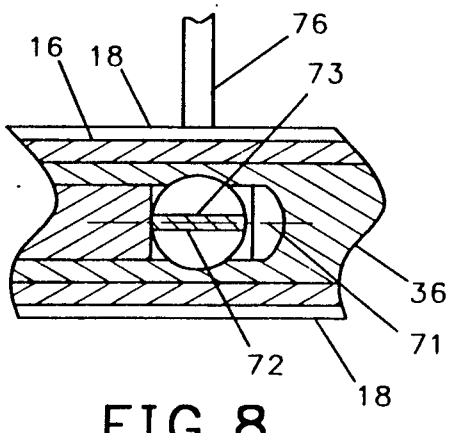
FIG. 8 is another fragmentary cross-sectional view of the rifle in FIG. 1 but showing the cocking lever and cam in the cocking position.
Figure 7:
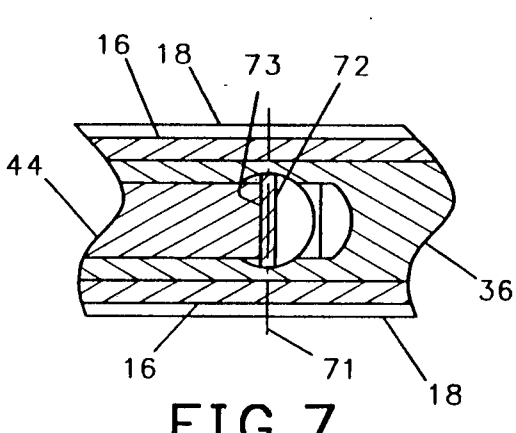
FIG. 7 is another fragmentary cross-sectional view of the rifle shown in FIG. 1 taken through line 7—7 of FIG. 1 showing the hammer in the fired position.
Figure 6:
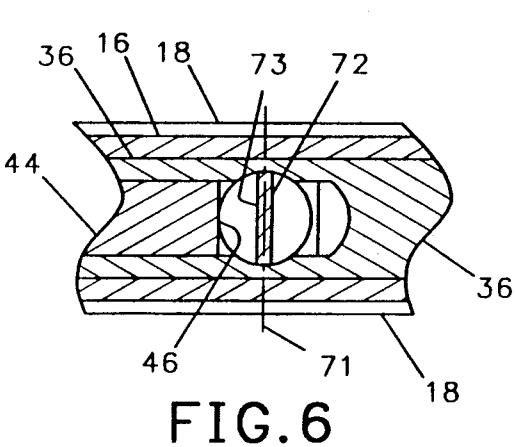
FIG. 6 is a fragmentary cross-sectional view taken through line 6—6 of FIG. 1 showing portions of the hammer, the cocking member, and the cam with the hammer in the cocked position.

An aperture 66 in the rearward portion 40 of the hammer sleeve 36 is aligned with a complementary aperture 68 in the receiver 16 to receive the distal end 69 of a cylindrical cocking member 70. The distal end 69 of the cocking member 70 does not extend into the rearward portion 40 of the axial bore 38 of the hammer sleeve 36. As best shown in FIG. 6, 7 and 8, a cam 72 in the form of a longitudinal rib having an axis 71 extends across the distal end 69 of the cocking member 70. The cocking member 70 and rib 72 are inserted into the apertures 66 and 68 upwardly into the rearward portion 40 of the bore 38 of the hammer sleeve 36 and the rib 72 is positioned so as to engage the first shoulder 50, but not interfere with the striking portion 46 of the hammer 44. The striking portion 46 of the hammer 44 is sufficiently long such that when the axis 71 of the cam 72 is transverse to the axis 14 of the barrel 12 and the first shoulder 50 of the hammer 44 abuts against the side 73 of the cam 72 as shown in FIGS. 2 and 7. The distal end 74 of the striking portion 46 of the hammer 44 will extend a short distance beyond the distal end 75 of the hammer sleeve 36. When the hammer 44 is positioned with the annular shoulder 50 abutting the side 73 of the cam 72 as shown in FIG. 7, and the distal end 74 of the striking portion 46 extending from the distal end 75 of the hammer sleeve 36, as shown in FIG. 2, the hammer 44 is in the fired position.

A handle 76 is provided at the lower end of the cylindrical cocking member 70 such that the user may use his fingers to rotate the cocking member 70 within a sleeve 78 and the cam 72 at the distal end 69 thereof will exert force against the shoulder 50 of the hammer 44 and cause the hammer 44 to move backwards and compress the spring 64. As shown in FIG. 8, when the cocking handle 76 is rotated, the hammer 44 will be moved sufficiently rearward within the receive 16 so as to be retained in a cocked position shown in FIG. 1 and as hereinafter described. The cocking member 70 is retained within the sleeve 78 by a pin 79 extending through a transverse bore therein.

The passageway 28 extends downward below the barrel 12 through the forward end 20 of the stock 18 and is defined by the inner bore 80 of a cylindrical sleeve 81 affixed to the barrel 12. A stock nut 82 having external threads 84 threadedly engages complementary threads 85 in an enlarged portion of the bore 80 in the sleeve 81 to define the lower end of the passageway 28. An orifice 86 in the sleeve 81 permits some of the gasses discharged through the narrow bore 26 in the breach plug 22 to be released into a cavity 87 in the stock 18 for retaining a ram rod, not shown.

As shown in FIG. 1 and FIG. 2, a removable primer holder 88 has an elongate cylindrical body 90 having an axis 91 a transverse upper end 93, and at the lower end thereof an enlarged cylindrical head 92 adapted to be grasped and turned with the human hand. The diameter of the body 90 is adapted to fit slideably within the bore 80 in the sleeve 81 defining the passageway 28. A transverse bore 94 having an axis 96 perpendicular to the axis of the cylindrical body 90 of the primer holder 88 is positioned near the upper first end 98 thereof. The transverse bore 94 is adapted to receive a suitable primer charge, such as a number 209 shot shell primer, or a large rifle primer, or a number 11 percussion cap. As shown in FIG. 2, the body 90 of the primer holder 88 has a length such that when the primer holder 88 is positioned within the cylindrical passageway 28 with the head 92 abutting the stock nut 82, the body 90 of the primer holder 88 will extend through the sleeve 81, and the aperture 32 in the barrel 12 and the first end 98 thereof will fit within the blind bore 34 in the barrel 12.

Figure 4:
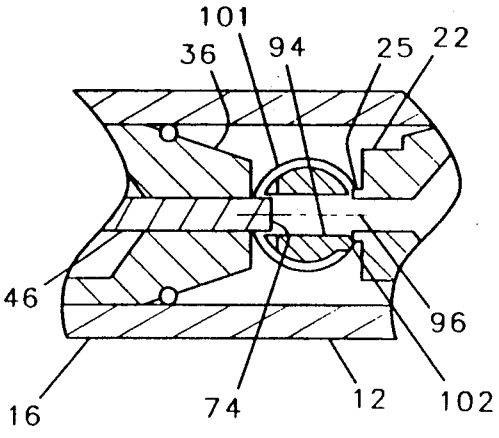
FIG. 4 is an enlarged fragmentary cross-sectional view of a rifle in accordance with FIG. 1 similar to FIG. 3 in which the primer holder is rotated into the fired position.

As shown in FIGS. 2 and 4, when the primer holder 88 is rotated such that the axis 96 of the transverse bore 94 is parallel to the central longitudinal axis 14 of the barrel 12 a primer charge fitted within the transverse bore 94 will be positioned between the hammer sleeve 36 and the rear wall 24 of the breach plug 22 and will be aligned with the forward portion 42 of the axial bore 38 in the hammer sleeve 36 on one side and on the other side with the small bore 26 in the rear wall 24 of the breach plug 22. When the primer holder 88 is positioned as shown in FIGS. 2 and 4, a charge fitted therein will be struck by the striking portion 46 of the hammer 44 when the hammer 44 moves from the cocked position shown in FIG. 1 to the fired position shown in FIG. 2. When the hammer 44 thus moves from the cocked position to the fired position, a charge within the transverse bore 94 will be exploded and a flame will flash through the small bore 26 of the rear wall 24 of the breach plug 22 and ignite the charge therein.

Figure 3:
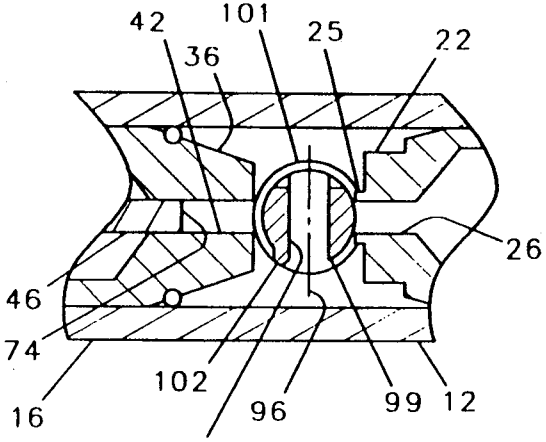
FIG. 3 is an enlarged fragmentary cross-sectional view taken through line 3—3 of FIG. 1 showing a primer holder inserted into the rifle of FIG. 1 and rotated into the loading position.
Figure 9:
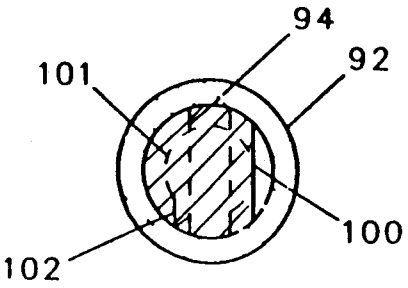
FIG. 9 is a cross-sectional view of a primer holder in accordance with the present invention taken through line 9—9 of FIG. 1.

Referring to FIG. 1, the upper end section 99 of the primer holder 88 has a flat 100 having a plane parallel to the axis 91 of the primer holder 88 to permit insertion of the primer holder into the passageway 28 without interfering with the nipple 25. As shown in FIG. 1, the nipple 25 of the breach plug 22 extends rearwardly into the passageway 28. When the primer holder 88 is fitted into the passageway 28, the nipple 25 will prevent the further insertion of the first end 98 thereof unless the flat 100 is turned toward the nipple 25 as shown in FIGS. 1 and 3. A groove 101 shown in phantom lines in FIG. 9 and in cross-section in FIGS. 3, 4 and 5 extends around a portion of the circumferences of the primer holder 88 in a plane parallel with transverse bore 94 and has a width which is greater than the outer diameter of the nipple 25 so as to receive the nipple 25 therein and permit rotation of the primer holder 88 when it is fully inserted into the passageway 28 as shown in FIG. 2. A stop 102 in the groove 101 prevents rotation of the primer holder 88 through a full 360 degrees and assist in aligning and adjusting of the primer holder into the firing and safety positions shown in FIGS. 4 and 5, respectively.

Figure 5:
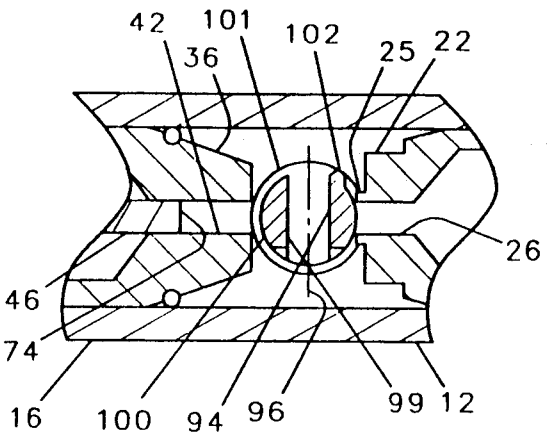
FIG. 5 is an enlarged fragmentary cross-sectional view of the rifle in FIG. 1 also similar to FIG. 3 in which the primer holder is rotated into the safety position.

When the primer holder 88 is rotated until the axis 96 of the transverse bore 94 is perpendicular to the central longitudinal axis 14 of the barrel 12 as shown in FIG. 5, a primer charge fitted into the transverse hole 94 will not be struck by the hammer when it moves from the cocked position to the fired position. The rotation of the primer holder to the position shown in FIG. 5 is, therefore, a safety position whereby the rifle 10 cannot be fired.

Figure 10:
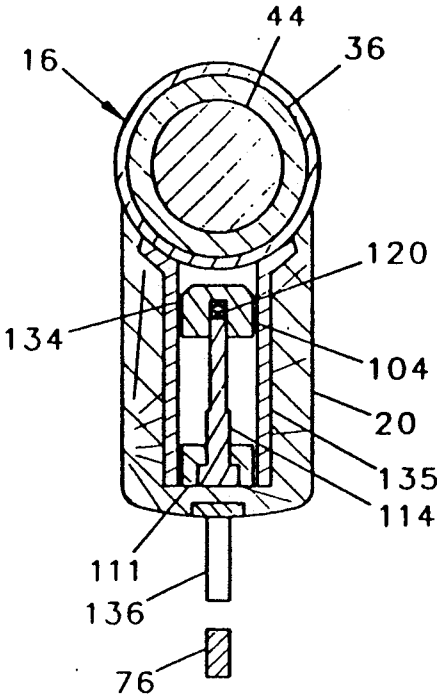
FIG. 10 is a fragmentary cross-sectional view of the rifle shown in FIG. 1 taken through line 10—10 of FIG. 1.

Referring further to FIG. 1, the rifle 10 further includes a trigger mechanism 103 having an elongate hammer sear 104 pivotally mounted on a centrally located transverse axis 105 and at the forward end of the hammer sear 104 is a pin 106. The pin 106 is adapted to extend through an aperture 108 in the receiver 16, and when the hammer 44 is in the cocked position, as shown in FIG. 1, the second shoulder 54 is adapted to be in a position adjacent the aperture 108 such that the hammer 44 can be retained in the cocked position by the pin 106 extending through the aperture 108 and abutting the second shoulder 54. The trigger mechanism 103 includes first and second lower end pieces 110 and 111, respectively, and as shown in FIG. 10, extending through the second lower end piece 111 is a first trigger adjustment screw 114 which extends slideably into a blind bore 116 in the distal end 118 of the hammer sear 104. A spring 120 positioned between the distal end of the first trigger adjustment screw 114 and the end surface of the blind bore 116 urges the distal end 118 of the hammer sear 102 upward and the pin 106 through the aperture 108 in the receiver 16.

A second hammer adjustment screw 122 threadedly extending through the hammer sear 104 and will abut against the undersurface of the receiver 16 when the pin 106 extends through the aperture 108. The second adjustment screw 122 provides adjustment of the length of the pin 106 which extends through the aperture 108. The first and second trigger adjustment screws 114, 122, respectively, will adjust the pressure required to pull the trigger and fire the rifle.

A trigger 124 pivotally mounted on a pin 125 has a lower finger grip 128 and an upper lever arm 130. The distal end 131 of the upper lever arm 130 is held against the rear end 132 of the hammer sear 104 by a spring 133 positioned between the lever arm 130 and the first lower end piece 110. As can be seen, a rearward pull on the finger grip 128 of the trigger 124 will exert an upward pressure on the rear end 132 of the hammer sear 104 and cause the pin 106 to be withdrawn from the aperture 108 and thereby allow the hammer 44 to be moved axially toward the muzzle 13 of the rifle 10 and causes it to fire as previously described. The trigger assembly 103 including the first and second lower end pieces 110 and 111, respectively, and the pins 105, 106 for the trigger 124 and hammer sear 104, respectively, are held in assembled relationship by side members 134, 135. Also, a trigger guard 136 protects the finger grip 128 from being inadvertently moved.

Figure 11:
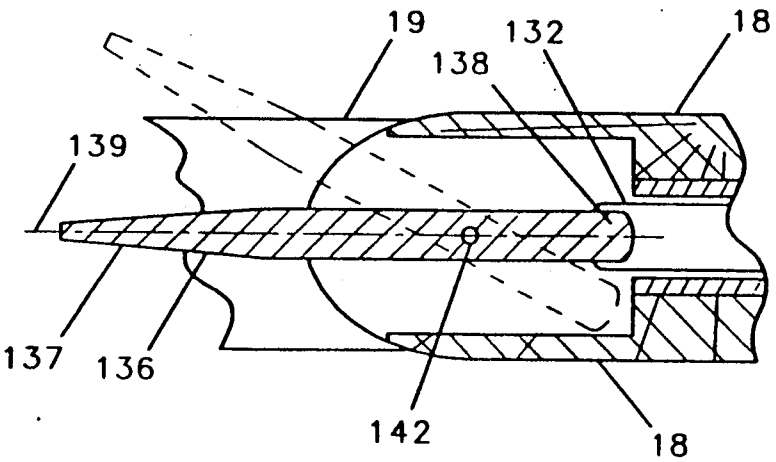
FIG. 11 is a fragmentary cross-sectional view of the rifle in FIG. 1 taken through line 11—11 of FIG. 1

As can be seen in FIG. 1, when the hammer 44 is in the cocked position, and the pin 106 extends through the aperture 108, there is a space between the rear end 132 of the hammer sear and the bottom of the receiver 16. As shown in FIG. 2, when the finger grip 128 of the trigger 124 is pulled, the rear end 132 of the hammer sear 104 moves upward. Referring to FIGS. 1, 2 and 11, a safety lever 137 having an inner spacer 138 and an outer lever arm 140 which pivots about a centrally located pivot pin 142 which is threaded into a complementary threaded bore in the lower rear end of the receiver 16.

The safety lever 136 is made of a suitable metallic material. As can best be seen in FIG. 11, when the longitudinal axis 139 of the lever arm 136 is positioned parallel to the central longitudinal axis 14 of the barrel 12, the spacer 138 is positioned between the rear end 132 of the hammer sear 104 and the bottom portion of the receiver 16 thereby preventing the hammer sear 104 from rotating upward about the pin 104 and preventing the rifle 10 from being fired. In order to fire the rifle 10, the handle 140 of the safety lever 136 must be moved either to the left or the right of the axis 14 of the barrel 12 of the rifle 10 as is shown in phantom lines in FIG. 11 such that the spacer 138 will no longer be between the rear end 132 of the sear 102 and the bottom of the receiver 16. The sear 102 is then permitted to rotate around the pin 104 such that the rifle 10 can be fired.

Figure 12:
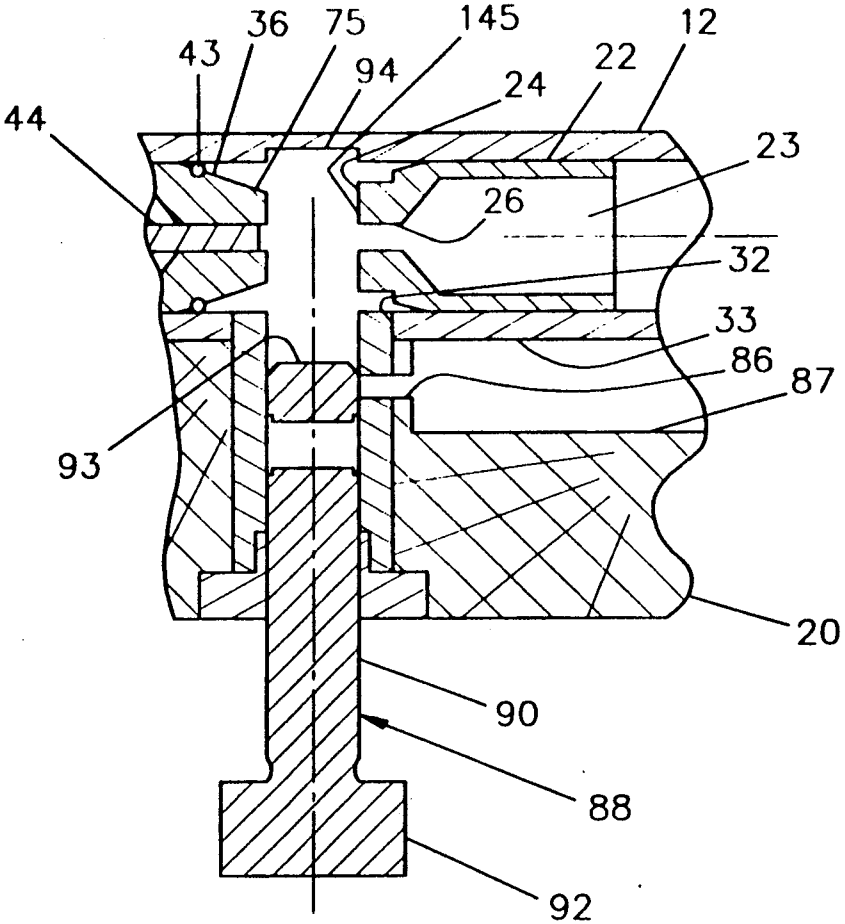
FIG. 12 is a fragmentary enlarged cross-section showing portions of the breach plug and primer holder when the primer holder is forced out of the passageway.

Referring to FIG. 12, if the weapon 10 is loaded with an excessive amount of gun powder, gasses from the powder chamber 23 will be exhausted through the flash hole 26 and into the upper portion of the passageway 28. The pressure of the gasses in the passageway 28 will force the hammer 44 rearward, and will apply a force to the upper end 93 of the primer holder 88 causing the primer holder to shear off the nipple 25 and eject the primer holder 88 out the bottom of the passageway 28. As a result, the damage suffered by the weapon is limited to the nipple 25 being sheared off. Furthermore, since the primer holder 88 is ejected downwardly, it is unlikely to cause injury to the user. The fragments of the sheared off nipples are not shown in FIG. 12 and only a substantially planar surface 145 remains on the rear wall of the breach plug 22. The thickness of the tubular nipple can be chosen such that much of the energy exhausted into the passage 28 from an overload of powder is expended in the shearing off of the nipple. As a result, the primer holder 88 will not be ejected at a high speed and will not be a danger to a user.

While the present invention has been described in connection with one embodiment, it will be apparent to those skilled in the art that many modifications and changes thereto may be made without departing from the true spirit and scope of the invention. Therefore, it is intended by the appended claims to cover all such changes and modifications which come within the true spirit and scope of the present invention.

What is claimed is:

1. A gun comprising in combination a tubular barrel having an outer wall and an inner axial bore, a hammer movable from a cocked position to a fired position, spring means for urging said hammer toward said fired position, said outer wall of said barrel having an aperture therein opening into said bore, said aperture having a given diameter, a primer holder having an elongate body and having a first end and having an annular groove around said first end, means for retaining a primer on said first end of said primer holder, said elongate body and said first end each having a width having dimensions less than said diameter of said aperture, a wall transverse at an end of said barrel, said wall having a flash hole extending therethrough, and a nipple extending rearwardly of said wall and having an outer dimension less than a width of said groove such that said nipple will fit within said groove to retain said primer holder within said aperture.

2. A gun in accordance with claim 1 wherein said nipple is tubular in shape and has a wall of a given thickness.

3. A gun in accordance with claim 2 wherein said wall of said nipple has a low resistance to shear so as to be sheared off when an excessive charge is fired in said barrel.

4. A gun in accordance with claim 1 wherein said hammer is enclosed within a receiver.

5. A gun in accordance with claim 3 wherein said hammer is enclosed within a receiver.

* * * * *